US007686656B2

(12) United States Patent
Zheng et al.

(10) Patent No.: US 7,686,656 B2
(45) **Date of Patent: *Mar. 30, 2010**

(54) ELECTRICAL CONNECTOR WITH IMPROVED CONTACTS

(75) Inventors: Qi-Sheng Zheng, Kunshan (CN); Hao Gu, Kunshan (CN); Jia-Yong He, Kunshan (CN); Yu-Long Mao, Kunshan (CN); Feng Qiao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,355

(22) Filed: Aug. 11, 2008

(65) Prior Publication Data

US 2009/0042421 A1 Feb. 12, 2009

(30) Foreign Application Priority Data

Aug. 10, 2007 (CN) ..... 2007 1 0025934

(51) Int. Cl.
*H01R 24/00* (2006.01)

(52) U.S. Cl. ..... 439/660; 439/79

(58) Field of Classification Search ..... 439/79, 439/80, 607.07–607.09, 607.11, 607.13, 439/607.35, 607.46, 939, 660
See application file for complete search history.

(56) References Cited

U.S. PATENT DOCUMENTS

| | | | | |
|---|---|---|---|---|
| 5,725,386 | A | 3/1998 | Davis et al. | |
| 5,779,489 | A | 7/1998 | Davis et al. | |
| 6,139,350 | A | 10/2000 | Mathesius | |
| 6,309,227 | B1 * | 10/2001 | Chen et al. | 439/79 |
| 6,364,706 | B1 | 4/2002 | Ando et al. | |
| 6,371,771 | B1 * | 4/2002 | Fan | 439/79 |
| 7,021,971 | B2 | 4/2006 | Chou et al. | |
| 7,104,848 | B1 | 9/2006 | Chou et al. | |
| 7,108,560 | B1 | 9/2006 | Chou et al. | |
| 7,125,287 | B1 | 10/2006 | Chou et al. | |
| 7,134,884 | B2 | 11/2006 | Wang et al. | |

(Continued)

FOREIGN PATENT DOCUMENTS

| | | |
|---|---|---|
| TW | M306723 | 2/2007 |

*Primary Examiner*—Thanh-Tam T Le
(74) *Attorney, Agent, or Firm*—Wei Te Chung; Andrew C. Cheng; Ming Chieh Chang

(57) ABSTRACT

An electrical connector includes an housing having a base portion, a tongue portion extending forwardly from the base portion and a number of passageways, the tongue portion defining a front face, a first side face and a second side face; a metal shell enclosing the tongue portion to define a receiving room therebetween, and defines a top wall, bottom wall and a pair of side walls, a first receiving room being formed between the bottom wall and the first side face; a number of contacts received in the passageways respectively and including a plurality of first contacts and second contacts, the first contacts each defining a first contacting portion, a first soldering portion and a first retaining portion, the second contacts each defining a second contacting portion, a second soldering portion and a second retaining portion. Both the second contacting portions and the first contacting portions are positioned on a same side of the second side face to be exposed to the first receiving room, the first contacting portions extend beyond the first side face.

12 Claims, 22 Drawing Sheets

U.S. PATENT DOCUMENTS

| | | | | |
|---|---|---|---|---|
| 7,232,346 | B2 | 6/2007 | Hu et al. | |
| 7,473,136 | B2 * | 1/2009 | Hu et al. | 439/607.01 |
| 7,517,253 | B1 * | 4/2009 | Chiang | 439/660 |
| 2006/0261474 | A1 | 11/2006 | Jiang et al. | |
| 2006/0286865 | A1 | 12/2006 | Chou et al. | |
| 2006/0294272 | A1 | 12/2006 | Chou et al. | |
| 2007/0117459 | A1 | 5/2007 | Chen | |
| 2009/0042420 | A1 * | 2/2009 | Zheng et al. | 439/83 |

* cited by examiner

ELECTRICAL CONNECTOR WITH IMPROVED CONTACTS

BACKGROUND OF THE INVENTION

1. Field of the Invention

The present invention relates to electrical connectors, more particularly to electrical connectors with additional contacts.

2. Description of Related Art

In information technology, Universal Serial Bus (USB) is a serial bus standard to interface devices. USB can connect computer peripherals such as computer mouse, keyboards, PDAs, gamepads and joysticks, scanners, digital cameras, printers, personal media players, and flash drives. For many of those devices, USB has become the standard connection method.

The design of USB is standardized by the USB Implementers Forum (USB-IF), an industry standards body incorporating leading companies from the computer and electronics industries. As of 2006, the USB specification was at version 2.0 (with revisions). The USB 2.0 specification was released in April 2000 and was standardized by the USB-IF at the end of 2001. The USB 2.0 specification is available from website: http://www.usb.org/home. Previous notable releases of the specification were 0.9, 1.0, and 1.1. Equipment conforming to any version of the standard will also work with devices designed to any previous specification (known as: backward compatibility).

The USB 2.0 specification defines several types of USB connectors such as Standard-A and Standard-B plugs and receptacles. Type-A plugs only mate with type-A receptacles, and type-B plugs only mate with type-B receptacles. FIG. 22 shows an existing USB 2.0 Standard-A plug 8, the Standard-A plug 8 includes an insulative plug tongue portion 80 formed of an insulating material, four conductive contacts 81 fixed on the insulative plug tongue portion 80. The four conductive contacts 81 located orderly from left to right are used to transfer power, D−, D+ and ground signals, respectively, the two central conductive contacts constitute a pair of differential contacts used to transfer/receive data. However, the current USB 2.0 version has a top data-transfer rate of 480 megabits per second which does not efficiently meet requirement of data transmission speed for Blue-ray and HD DVD.

BRIEF SUMMARY OF THE INVENTION

According one aspect of the present invention, an electrical connector to be mounted on a printed circuit board, comprises an insulative housing having a base portion, a tongue portion extending forwardly from the base portion and a plurality of passageways, the tongue portion being thinner than the base portion and defining a front face, a first side face and a second side face opposite to the first side face; a metal shell attached to the base portion to enclose the tongue portion to define a receiving room therebetween, and defines a top wall, bottom wall and a pair of side walls, a first receiving room being formed between the bottom wall and the first side face, a second receiving room being formed between the top wall and the second side face; a plurality of contacts received in the passageways respectively and including a plurality of first contacts and a plurality of second contacts, the first contacts each defining a first contacting portion, a first soldering portion and a first retaining portion connecting with the first contacting portion and the first soldering portion, the second contacts each defining a second contacting portion, a second soldering portion and a second retaining portion connecting with the second contacting portion and the second retaining portion; and wherein both the second contacting portions and the first contacting portions are positioned on a same side of the second side face to be exposed to the first receiving room, the second contacting portions are located between the first side face and the second side face, the first contacting portions extend beyond the first side face.

According to another aspect of the present invention, an electrical connector comprises a mounting face to be mounted onto a printed circuit board; a front mating face to mating with a corresponding plug; an insulative housing having a base portion, a tongue portion extending forwardly from the base portion and a plurality of passageways, the tongue portion being thinner than the base portion and defining a front face, a first side face and a second side face opposite to the first side face; a metal shell attached to the base portion to enclose the tongue portion to define a receiving room therebetween; a plurality of contacts received in the passageways respectively and including a plurality of first contacts and a plurality of second contacts, the first contacts each defining a first contacting portion, a first soldering portion and a first retaining portion connecting with the first contacting portion and the first soldering portion, the second contacts each defining a second contacting portion, a second soldering portion and a second retaining portion connecting with the second contacting portion and the second retaining portion. Both the second contacting portions and the first contacting portions are positioned on a same side of the second side face, the second contacting portions and the first contacting portions are not located on a same plane along a height direction of the tongue portion, the first contacting portions are arranged in a first row, the second contacting portions are arranged in a second row which is in front of the first row.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1A:
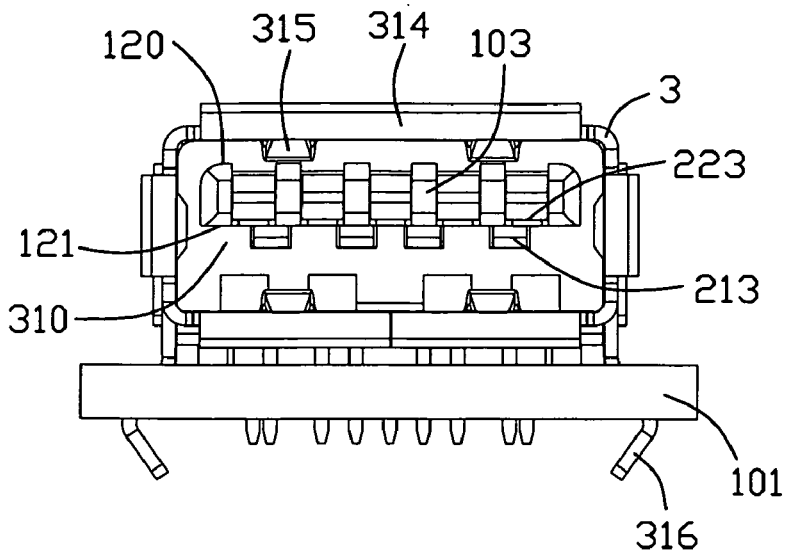
FIG. 1A is a perspective view of an electrical connector mounted on a mother PCB according to a first embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, receptacle, plug, and signaling all refer to the USB architecture described within the Universal Serial Bus Specification, 2.0 Final Draft Revision, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plug.

Referring to FIGS. 1A-6, an electrical connector 100 is preferably a receptacle mounted on a mother PCB 101 and is compatible to USB 2.0 protocol to transmit USB signals. The electrical connector 100 is used to accommodate a second plug 7 or a first plug which is an existing USB 2.0 standard type-A plug 8. The second plug 7 includes a tongue portion 70 which has a same mechanical dimension as the tongue portion 80 of the USB 2.0 standard type-A plug 8. The second plug 7 further comprises four first contacts 71 having the same function as the four conductive contacts 81 of the USB 2.0 standard type-A plug 8 and five additional contacts 72. The five additional contacts 72 define two pairs of differential contacts and a grounding contact positioned between the two pairs of differential contacts.

The electrical connector 100 includes an insulative housing 1, a plurality of contacts 2 held in the insulative housing 1, a metal shell 3 enclosing the insulative housing 1. The metal shell 3 has a front shell 31 and a real shell 32 cooperating with the front shell 31. The electrical connector 100 defines a mounting face 102 to be mounted onto the PCB 101 and a front mating face 103 to mate with the first plug 8 or the second plug 7.

The front shell 31 defines a top wall 311, bottom wall 312, and a pair of side walls 313 connecting with both the top wall 311 and the bottom wall 312. The insulative housing 1 includes a base portion 11 and a tongue portion 12 extending forwardly from a front face of the base portion 11 which is thinner than the base portion 11. The tongue portion 12 has a dimension which is substantially the same as a tongue portion of an existing USB 2.0 standard type-A receptacle. A receiving room 310 is formed between the metal shell 3 and the tongue portion 12 to accommodate the first plug 8 or the second plug 7. The tongue portion 12 is spaced from the top wall 311 with a first distance and spaced from the bottom wall 312 with a second distance which is longer than the first distance. A plurality of post 102 extend downwardly from a bottom face of the base portion 11 to abut against the PCB 101, the mounting face 102 is defined as bottom faces of the post 102.

The contacts 2 includes a plurality of first contacts 21 and a plurality of second contacts 22, an arrangement of the first contacts 21 is same as contacts of the existing USB 2.0 standard type-A receptacle, that is to say, the first contacts 21 are arranged orderly from left to right to include a power contact 217, a D– contact, a D+ contact and a ground contact 219, respectively, the two central conductive contacts (the D– contact and the D+ contact) constitute a pair of differential contacts 218 used to transfer/receive data. The first contacts 21 each comprises a first contacting portion 210 for contacting with flat contacts 81, 71, a first retaining portion 211 fixed with the insulative housing 1, and a first soldering portion 212 extending from one end of the first retaining portion 211 to be soldered with the PCB 101. The first contacting portion 210 is configured to be a flexible arm.

The tongue portion 12 has a front face 103, a first side face 121 to abut against a corresponding tongue portion of the first plug 8 or the second plug 7 and a second side face 120 being parallel to the first side face 121, in the first embodiment, the first side face 121 and the second side face 120 are preferably configured as a bottom face and a top face of the tongue portion 12 respectively. The first contacting portion 210 projects downwardly beyond the first side face 121, contacting plane between the first contacting portions 210 and the first plug 8 or the second plug 7 is located below the first side face 121. Four first passageways 1211 is recessed from the first side face 121 to receive the first contacts 21. The first soldering portions 212 are retained in first vertical slots 111 formed on a rear portion of the base portion 11 to be mounted onto the PCB 101.

Compared to the existing USB 2.0 standard type-A receptacle, the second contacts 22 is added to the electrical connector 100 to enhance data transmission capability. The second contacts 22 include a first pair of differential contacts 225, a second pair of differential contacts 227 and a ground contact 226 positioned therebetween. The second contacts 22 is only used to contact with the five additional contacts 72 of the second plug 7, and each includes a second contacting portion 220, a second retaining portion 221 fixed with the insulative housing 1, and a second soldering portion 222 angled from one end of the second retaining portion 221 to be soldered onto the PCB 101. The second contact portions 220 are stiff and not resilient and configured to be flat. The first contacting portions 210 each defines a first contacting area 213 for contacting with the corresponding conductive contacts 81 of the USB 2.0 Standard-A plug 8 or the corresponding first contacts 71 of the second plug 7.

A first receiving room is formed between the bottom wall 312 and the first side face 121, a second receiving room is formed between the top wall 311 and the second side face 120. Both the second contacting portions 220 and the first contacting portions 210 are positioned on a same side of the second side face 120 to be exposed to the first receiving room, the second contacting portions 220 are located between the first side face 121 and the second side face 120, the first contacting portions 210 extend beyond the first side face 121, the first contacting portions 210 and the second contacting portions 220 are positioned on opposite sides of the first side face 121. The second contacting portions 220 are flat and non-elastic, the first contacting portions 210 are elastic and deflectable along a height direction of the tongue portion. The first contacting portions 210 are arranged in a first row, the second contacting portions 220 are arranged in a second row which is located in front of the first row. The second contacting portion 220 and the second retaining portion 221 are parallel to each other, the second retaining portion 221 is exposed to the second receiving room.

Figure 1B:
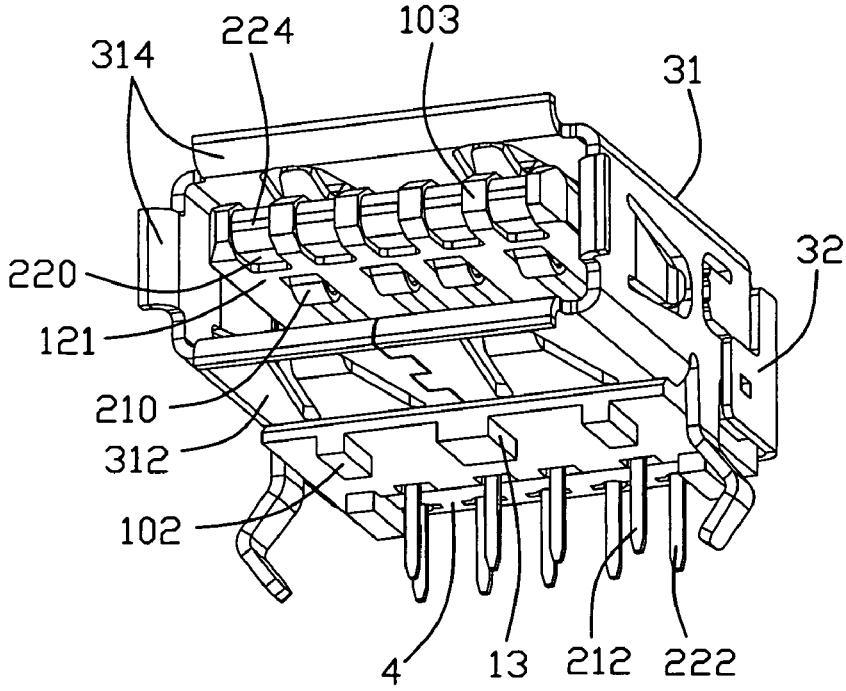
FIG. 1B is another perspective view of the electrical connector, while viewed from another aspect.
Figure 2:
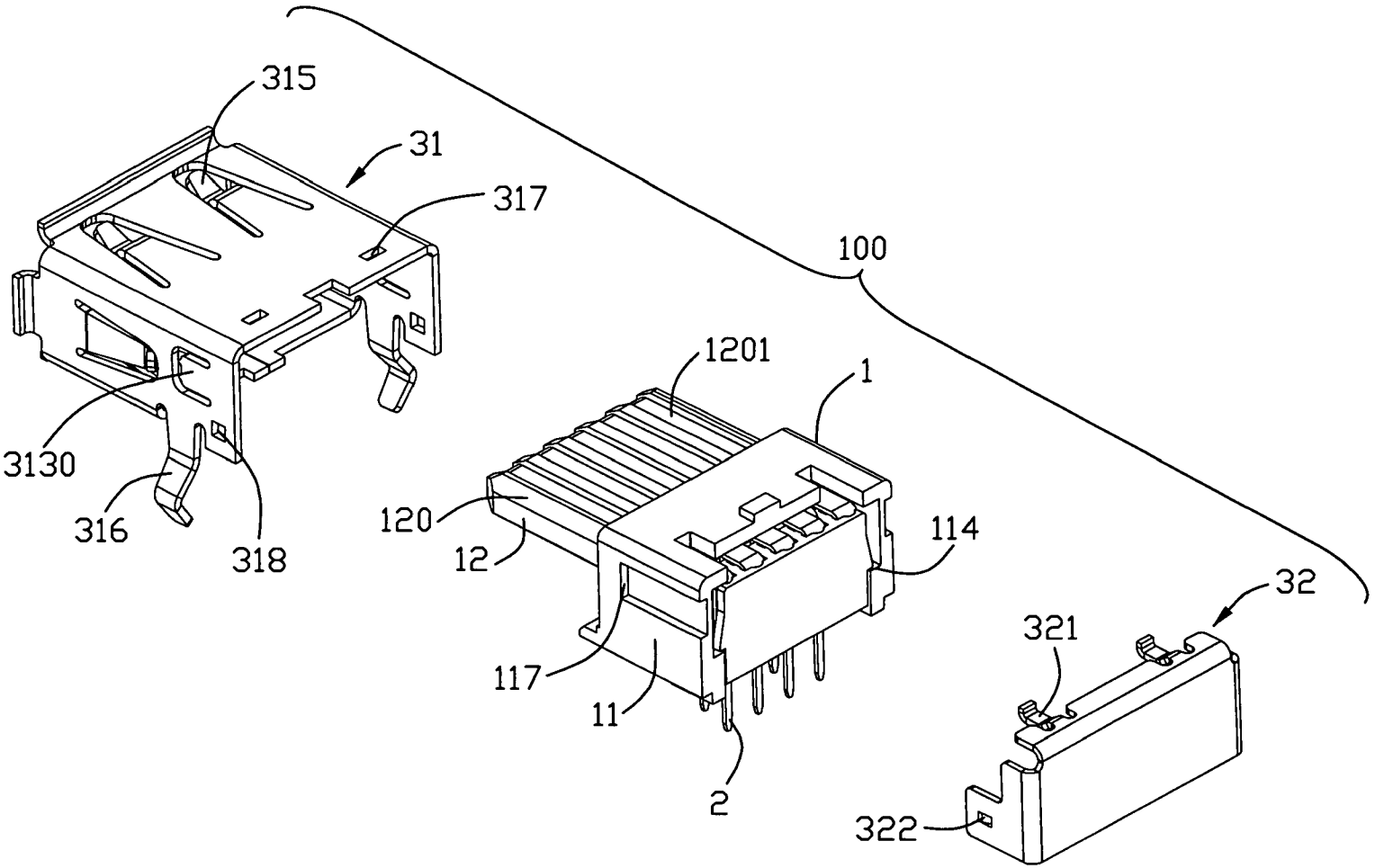
FIG. 2 is a partly exploded view of the electrical connector according to the first embodiment of the present invention.
Figure 3:
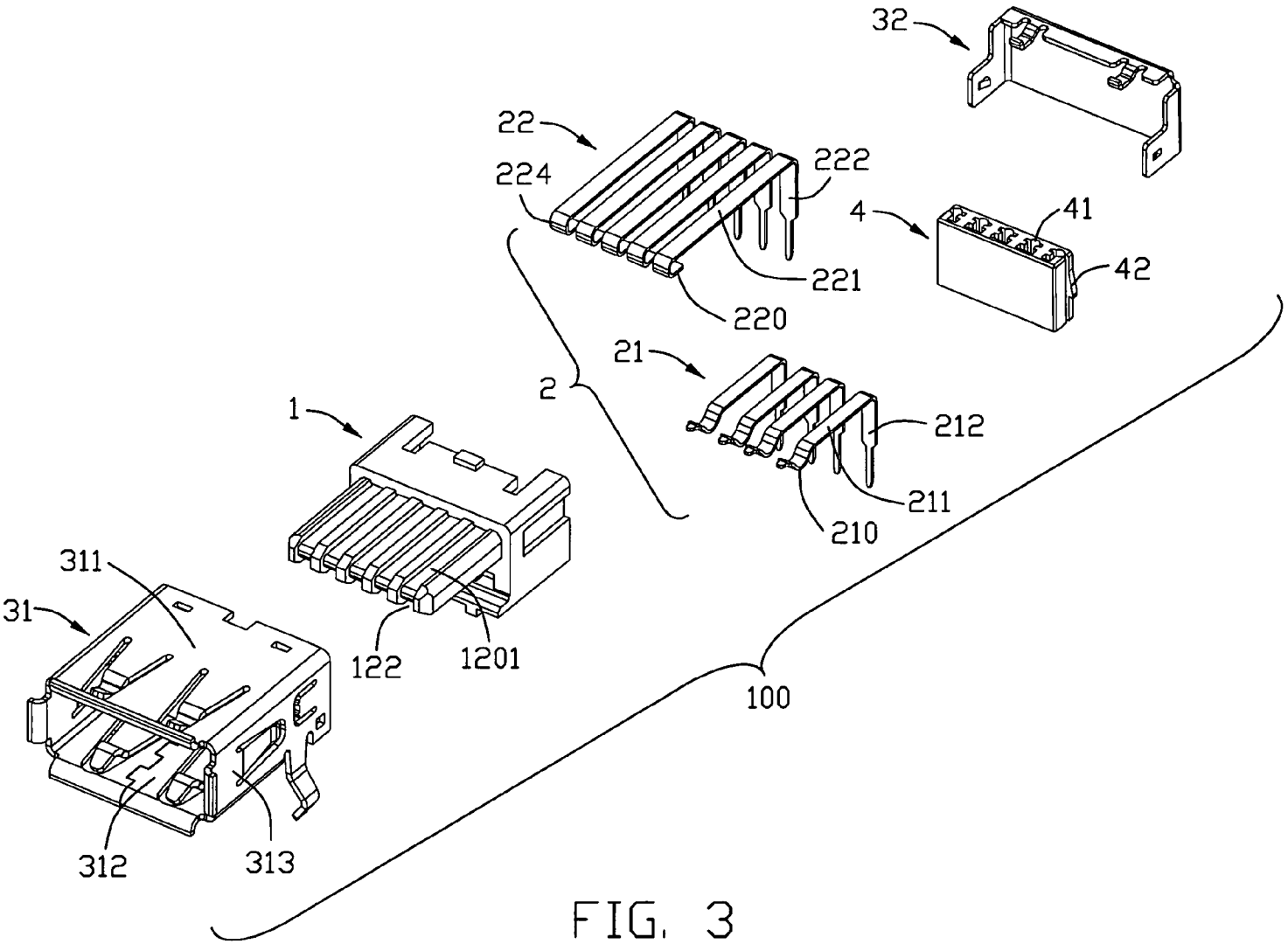
FIG. 3 is an exploded view of the electrical connector according to the first embodiment of the present invention.
Figure 4:
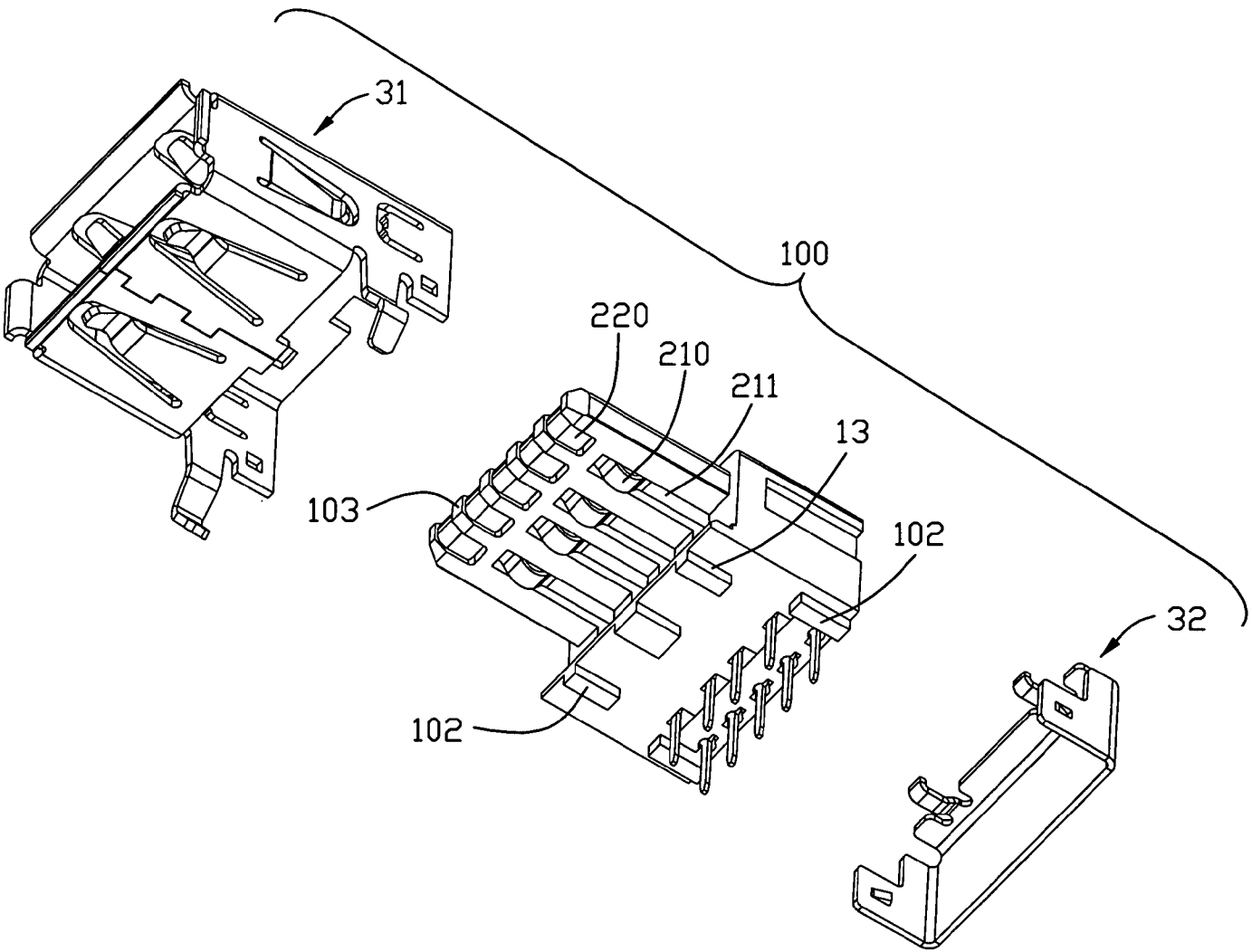
FIG. 4 is an another partly exploded view of the electrical connector shown in FIG. 2, while taken from another aspect.
Figure 5:
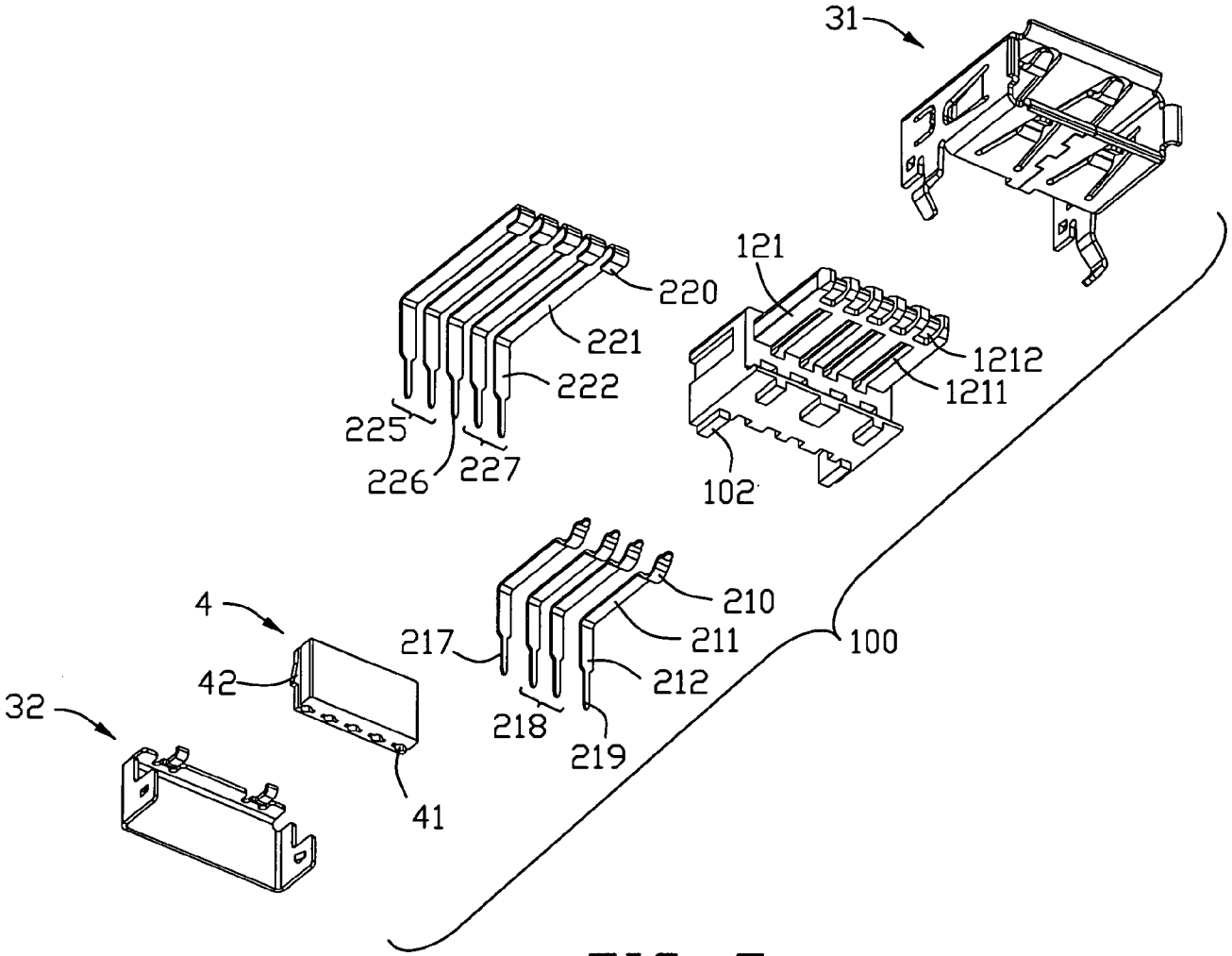
FIG. 5 is an another exploded view of the electrical connector according to the first embodiment of the present invention.
Figure 6:
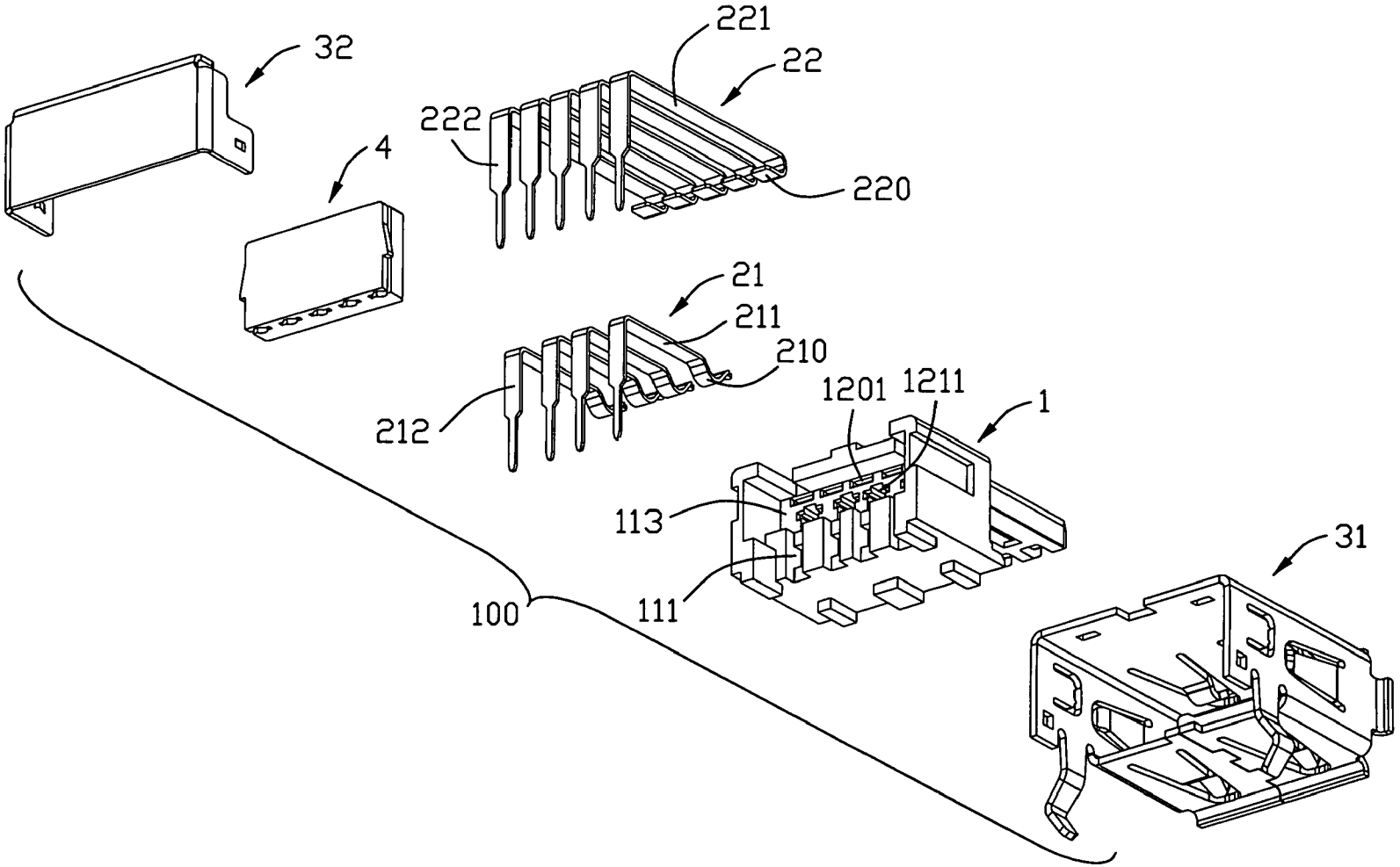
FIG. 6 is a view similar to FIG. 5, while taken from a different aspect.

The second contacting portions 220 each defines a second contacting area 223 for contacting with the corresponding additional contacts 72 of the second plug 7. Referring to FIGS. 1A and 1B, the first contacting area 213 and the second contacting area 223 are positioned on opposite sides of the first side face 121. The second contact portions 220 are located above the first contact portions 210 along a height direction of the tongue portion 12. The first and the second contact portions 210, 220 are isolated from each other to avoid undesirable signal transmission.

The second side face 120 includes five third passageways 1201 to receive the second retaining portions 221 respectively, the second contacting portions 220 are parallel to the second retaining portions 221 and is positioned beneath the second retaining portions 221. A connecting arm 224 is formed to interconnect the second contacting portion 220 and the second retaining portions 221, the second contacting portion 220 and the second retaining portions 221 extend rearward from a lower end and an upper end of the connecting arm 224 respectively.

The first side face 121 defines a plurality of second passageways 1212 for receiving the second contacting portions 220, the second passageways 1212 is arranged in front of the first passageways 1211. The front end of the tongue portion 12 is cut away to form a concave portion 122 to receive the connecting arm 224. The concave portion 122 communicates with the second passageways 1212 and the third passageways 1201. The second soldering portion 222 is retained on the base portion 11 and projects outside the base portion 11. The second retaining portions 221 are positioned on an upper portion of the tongue portion 12. Both the first contacting portions 210 and the second contacting portions 220 are located on a lower portion of the tongue portion 12 to lie on a same side of the second side face 120 of the tongue portion 12. The second contact portions 220 are positioned before the first contact portions 210 along a length direction of the tongue portion 12.

The front shell 3 is provided with a plurality of spring tabs 315 extending into the receiving room 310 to abut against the existing USB 2.0 standard type-A plug 8 and the second plug 7 and a plurality of guiding plates 314 for facilitating an insertion of the plug 7, 8. The side face 313 of the front shell 31 is formed with a soldering leg 316 soldered to the PCB 101. A locking hole 317 is formed on a rear portion of the top wall 311 to lock with a latching arm 321 on the rear shell 32. The rear shell 32 defines a pair of protrusions 322 to latch with an opening 318 on the side face 313 of the front shell 31.

A receiving cavity 113 is recessed on the base portion 11 to retain a spacer 4, the spacer 4 has five through holes 41, the second soldering portions 222 are inserted into the through holes 41 and extend downwardly beyond the spacer 4. The spacer 4 defines a pair of latching arms 42 to be fixed by supporting plate 114 and attached to the base portion 11.

Figure 7A:
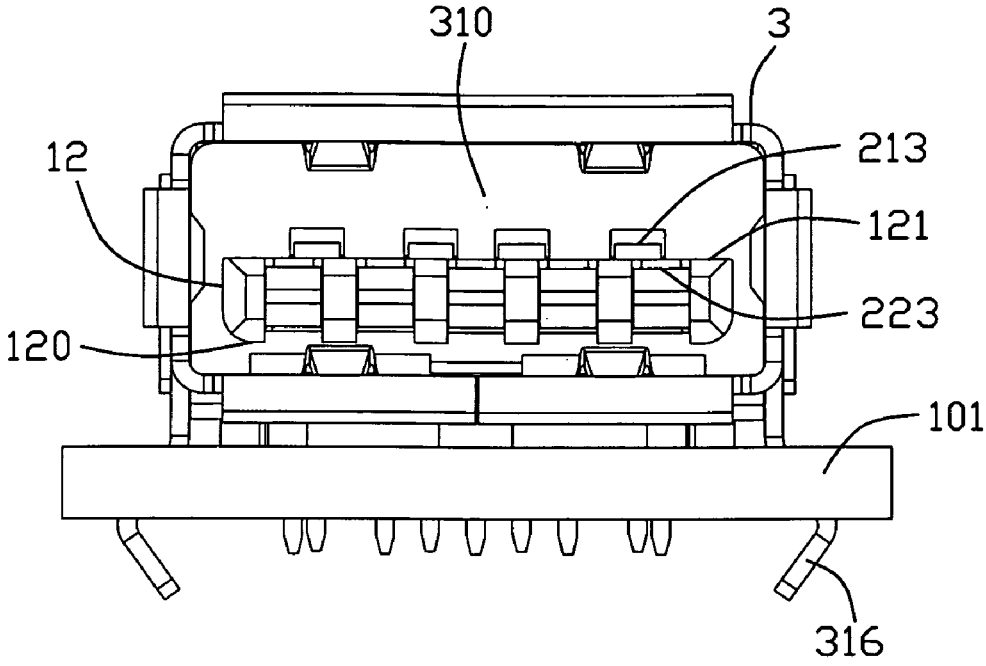
FIG. 7A is a perspective view of an electrical connector mounted on a mother PCB according to a second embodiment of the present invention.
Figure 7B:
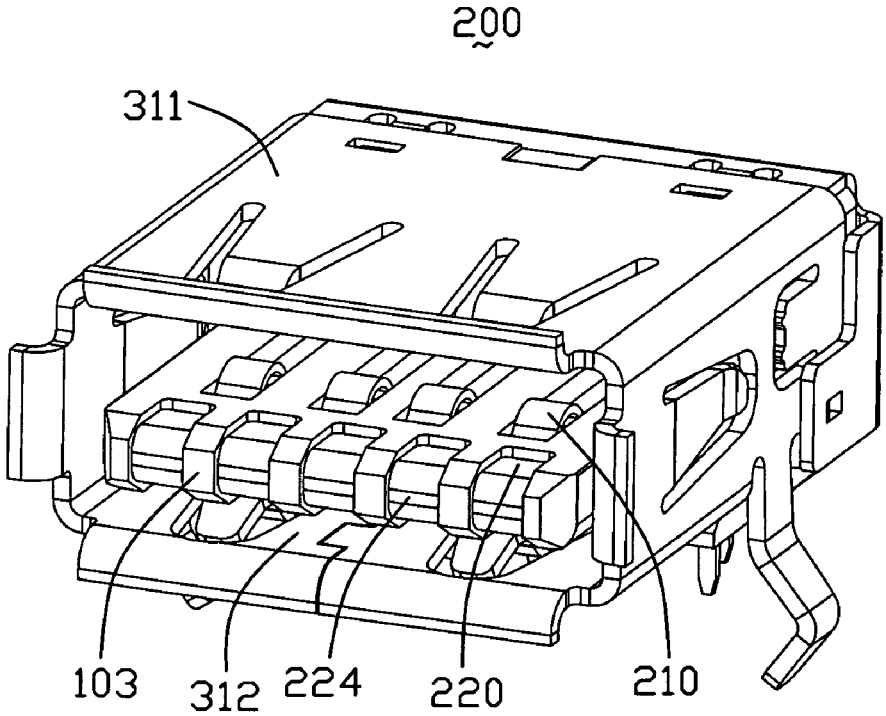
FIG. 7B is another perspective view of the electrical connector shown in FIG. 7A.
Figure 8:
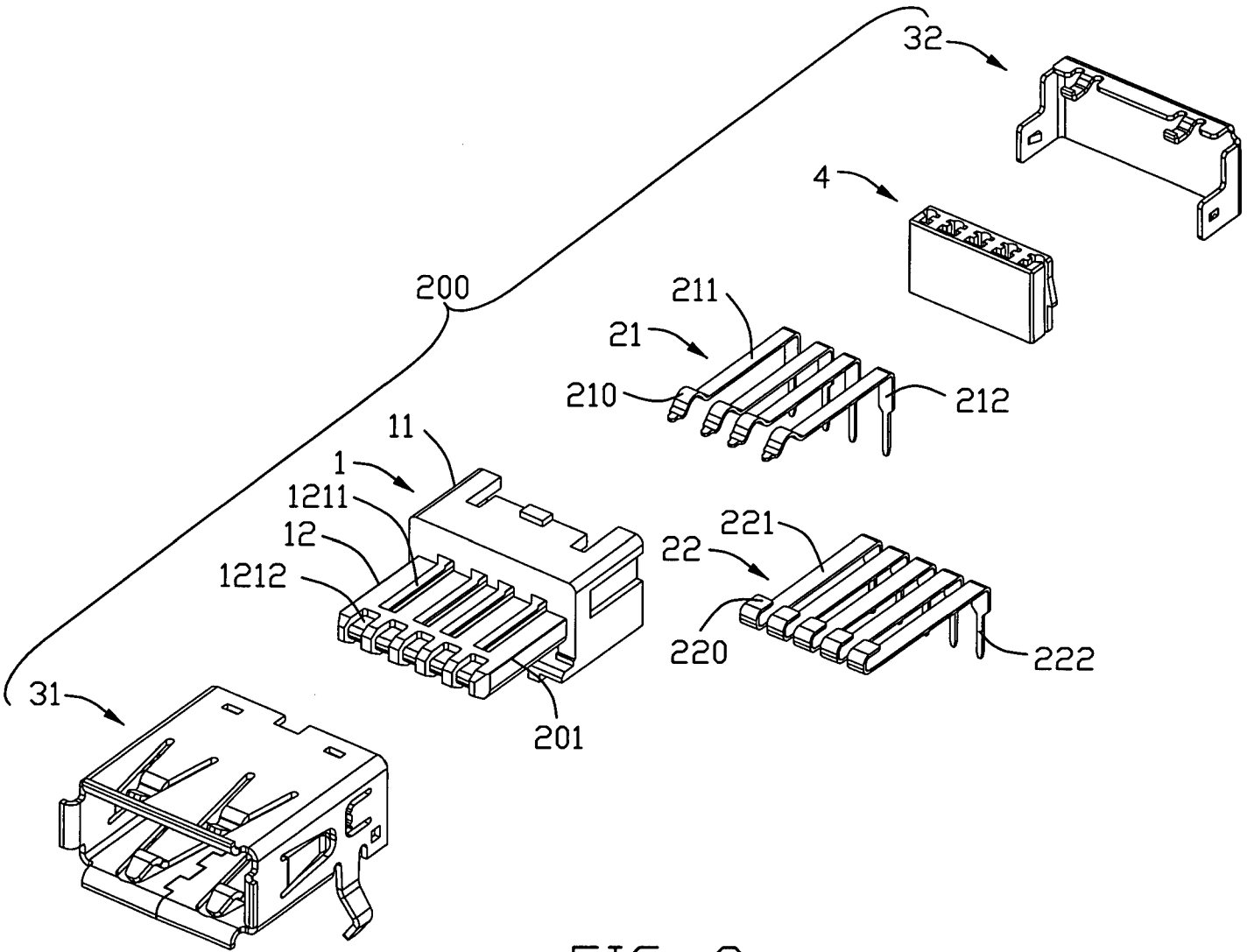
FIG. 8 is an exploded view of the electrical connector according to the second embodiment of the present invention.

Referring to FIGS. 7A-8, a second embodiment of the electrical connector 200 is similar to the first embodiment shown in FIGS. 1A-7B, and differs in that the tongue portion 12 is spaced from the top wall 311 with a first distance and spaced from the bottom wall 312 with a second distance which is shorter than the first distance, the first passageways 1211 and the second passageways 1212 are formed on an upper portion of the tongue portion 12, the third passageways 1201 are formed on a lower portion of the tongue portion 12, the first side face 121 and the second side face 120 are preferably configured as a top face and a bottom face of the tongue portion 12 respectively, the first contacting portion 210 and the second contacting portion 220 are located on an upper portion of the tongue portion 12. The first receiving room is formed between the top wall 311 and the first side face 121, the second receiving room is formed between the bottom wall 312 and the second side face 120.

Figure 9A:
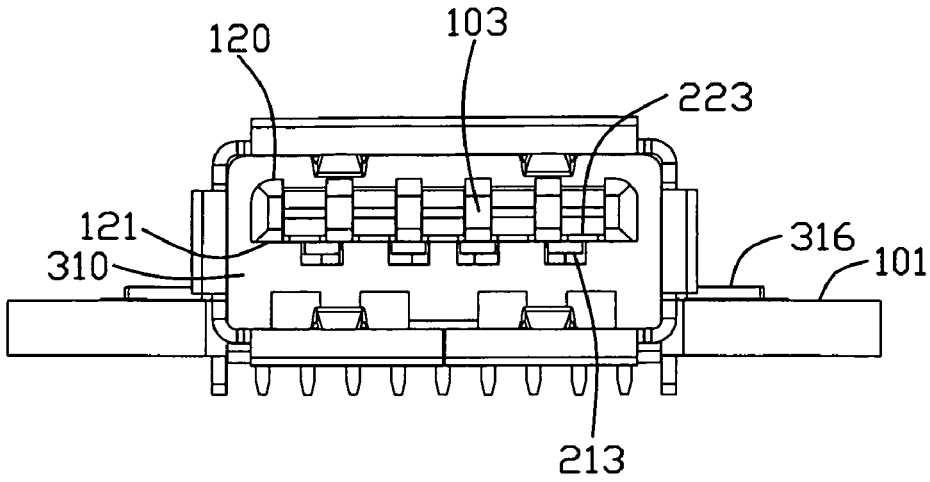
FIG. 9A is a perspective view of an electrical connector mounted on a mother PCB according to a third embodiment of the present invention.
Figure 9B:
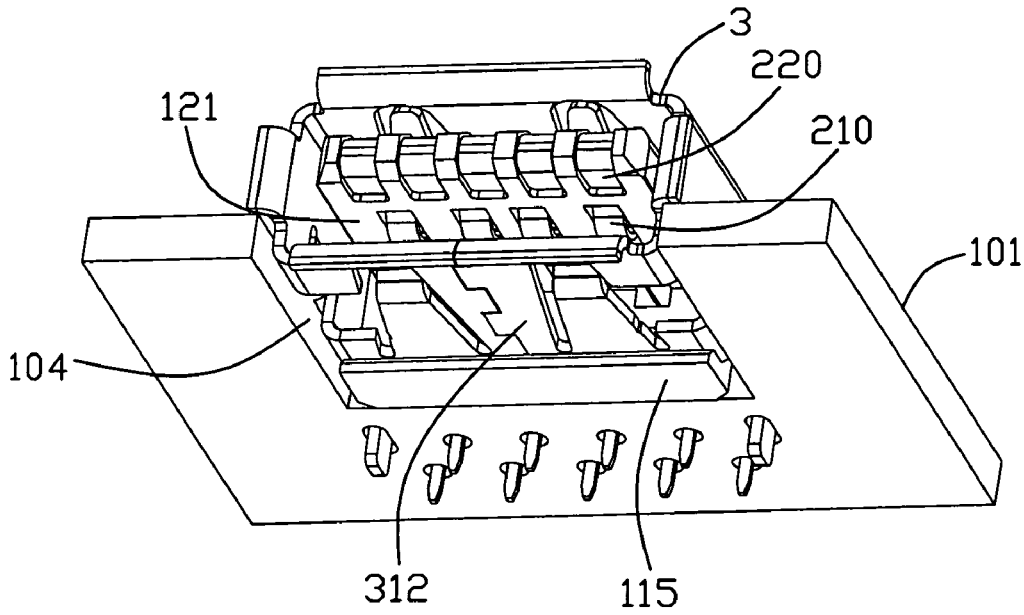
FIG. 9B is a view similar to FIG. 9A, while taken from a different aspect.
Figure 10:
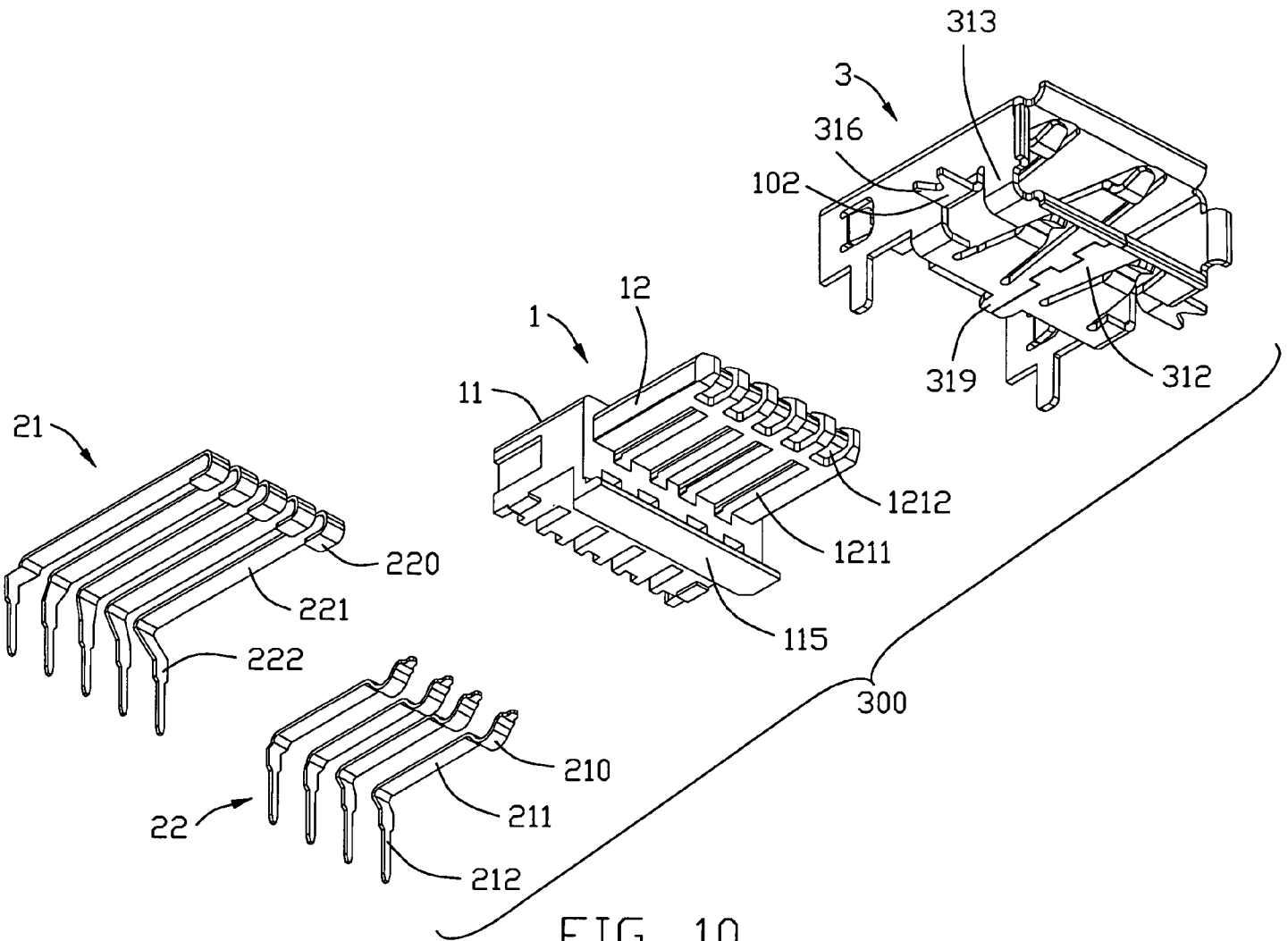
FIG. 10 is an exploded view of the electrical connector according to the third embodiment of the present invention.
Figure 11A:
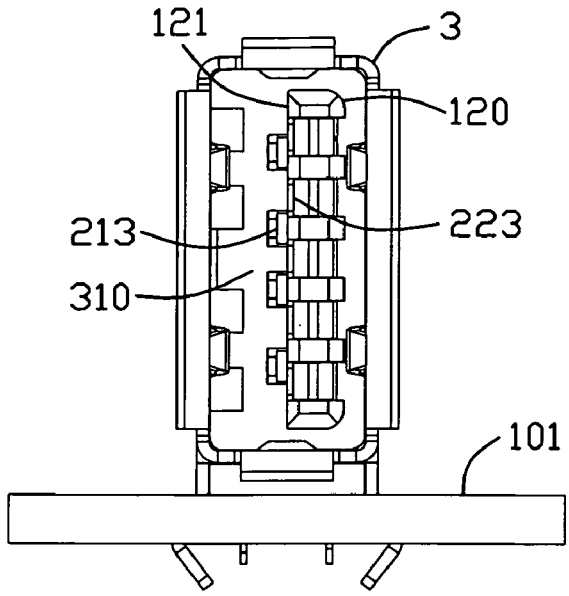
FIG. 11A is a perspective view of an electrical connector mounted on a mother PCB according to a fourth embodiment of the present invention.
Figure 11B:
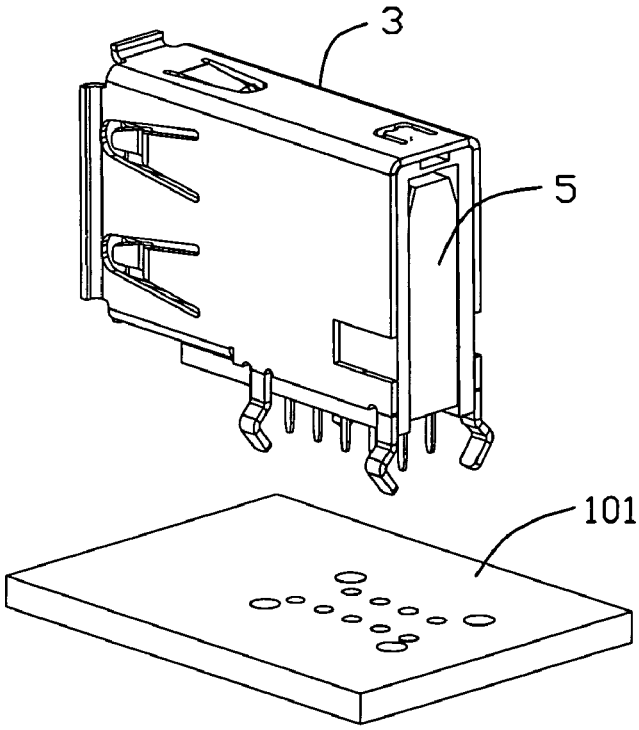
FIG. 11B is a partly exploded perspective view of the electrical connector and the mother PCB shown in FIG. 11A.
Figure 12:
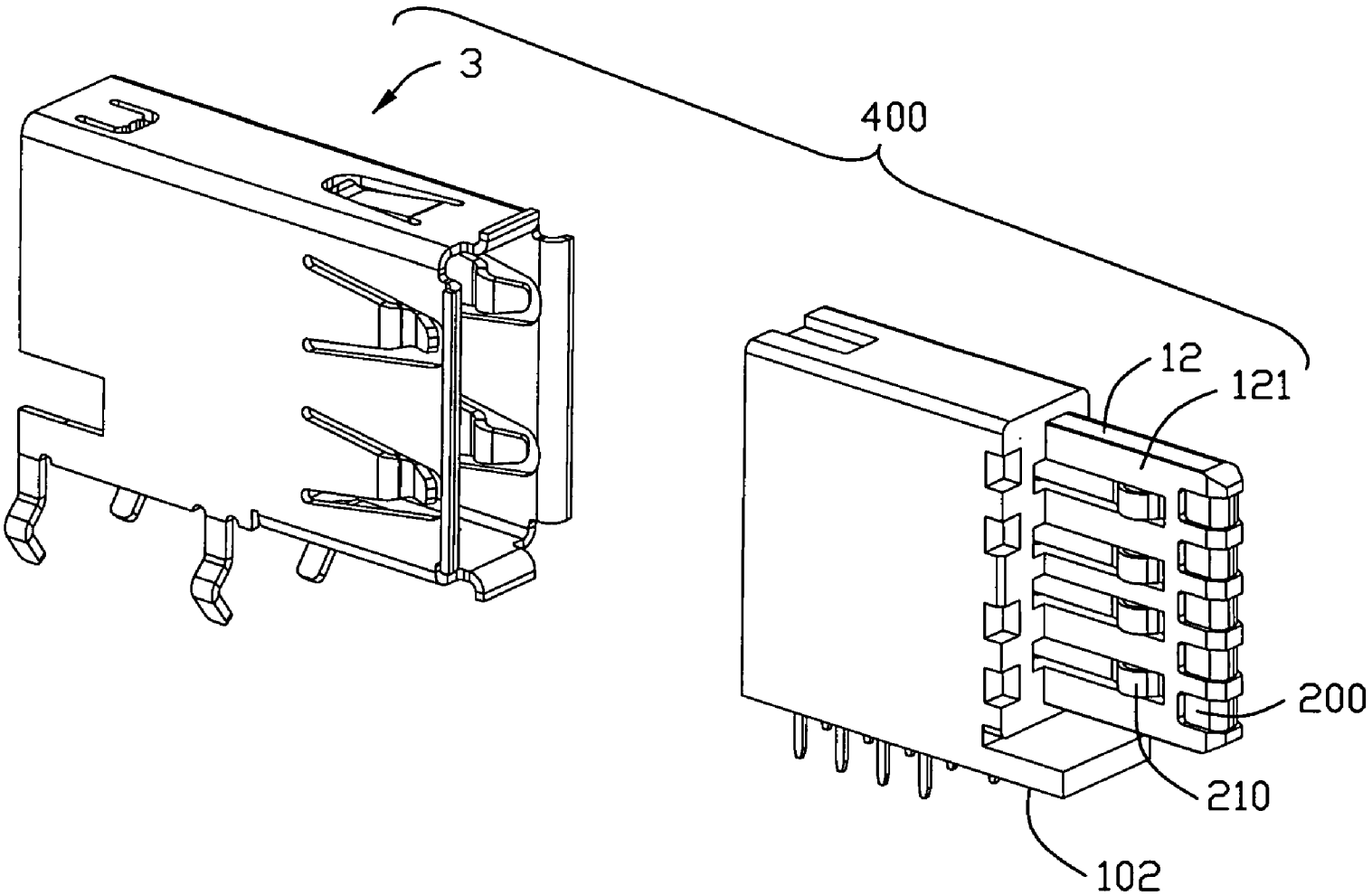
FIG. 12 is a partly exploded view of the electrical connector according to the fourth embodiment of the present invention.
Figure 13:
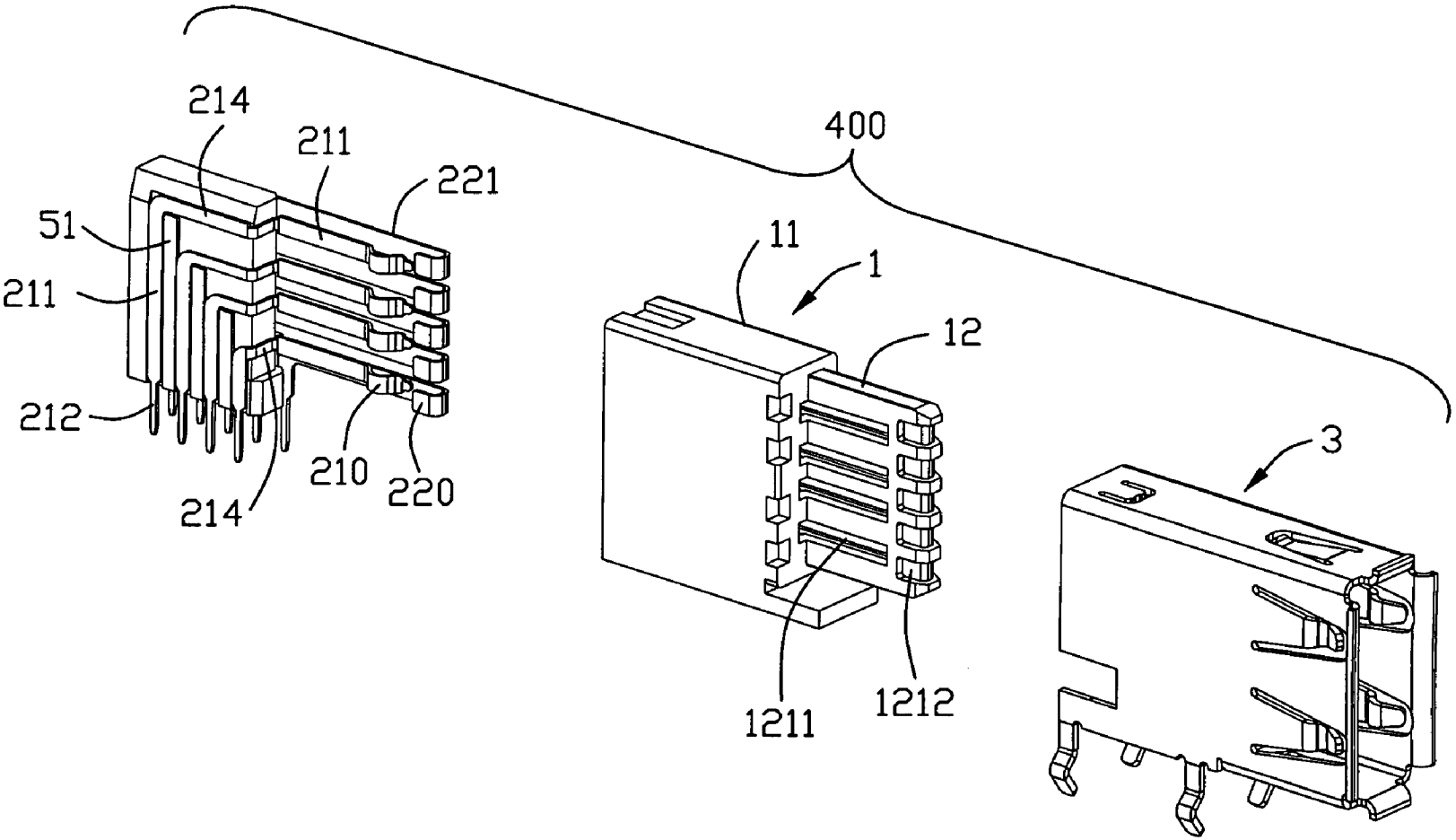
FIG. 13 is an another partly exploded view of the electrical connector according to the fourth embodiment of the present invention.
Figure 14:
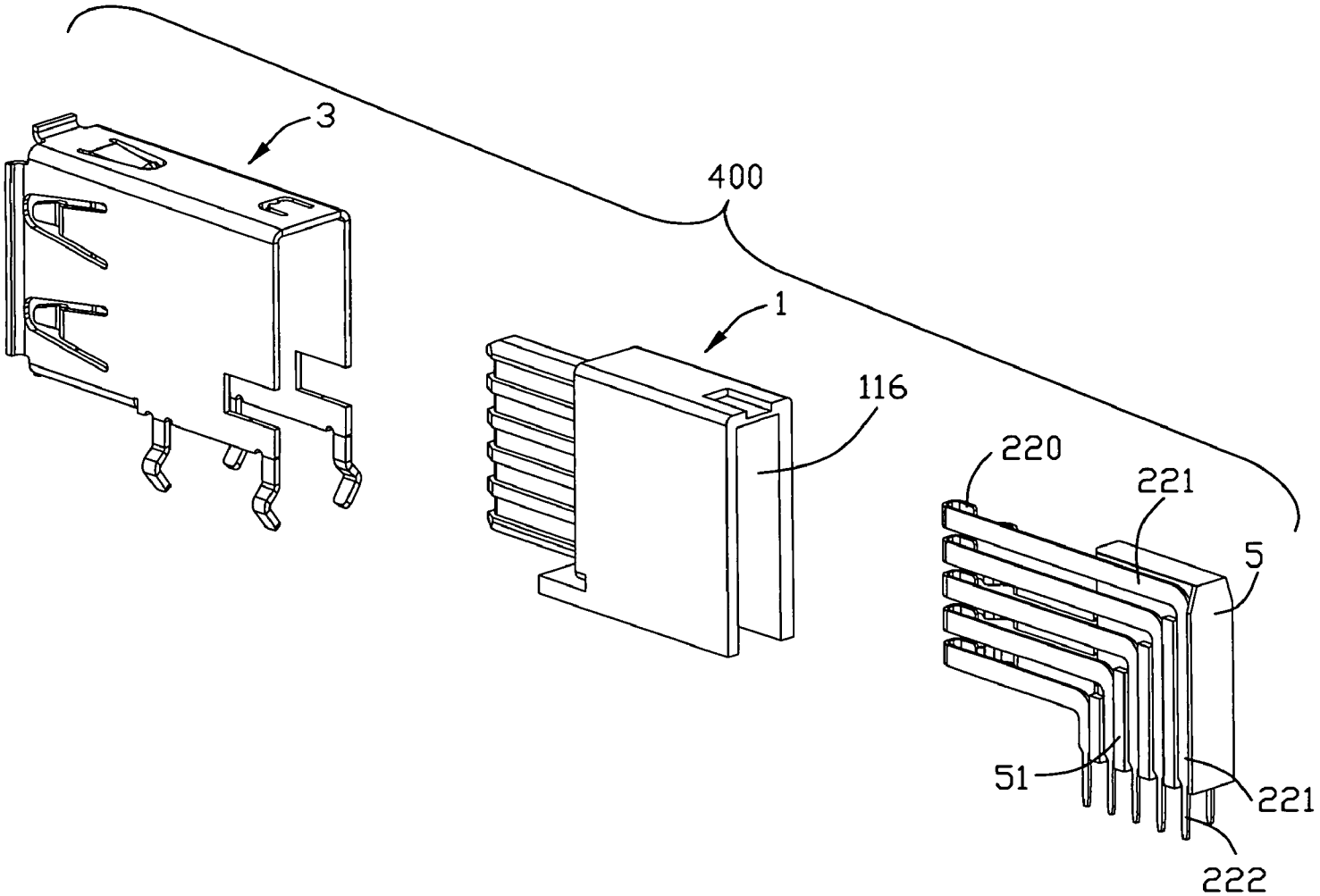
FIG. 14 is a view similar to FIG. 13, while taken from a different aspect.
Figure 15:
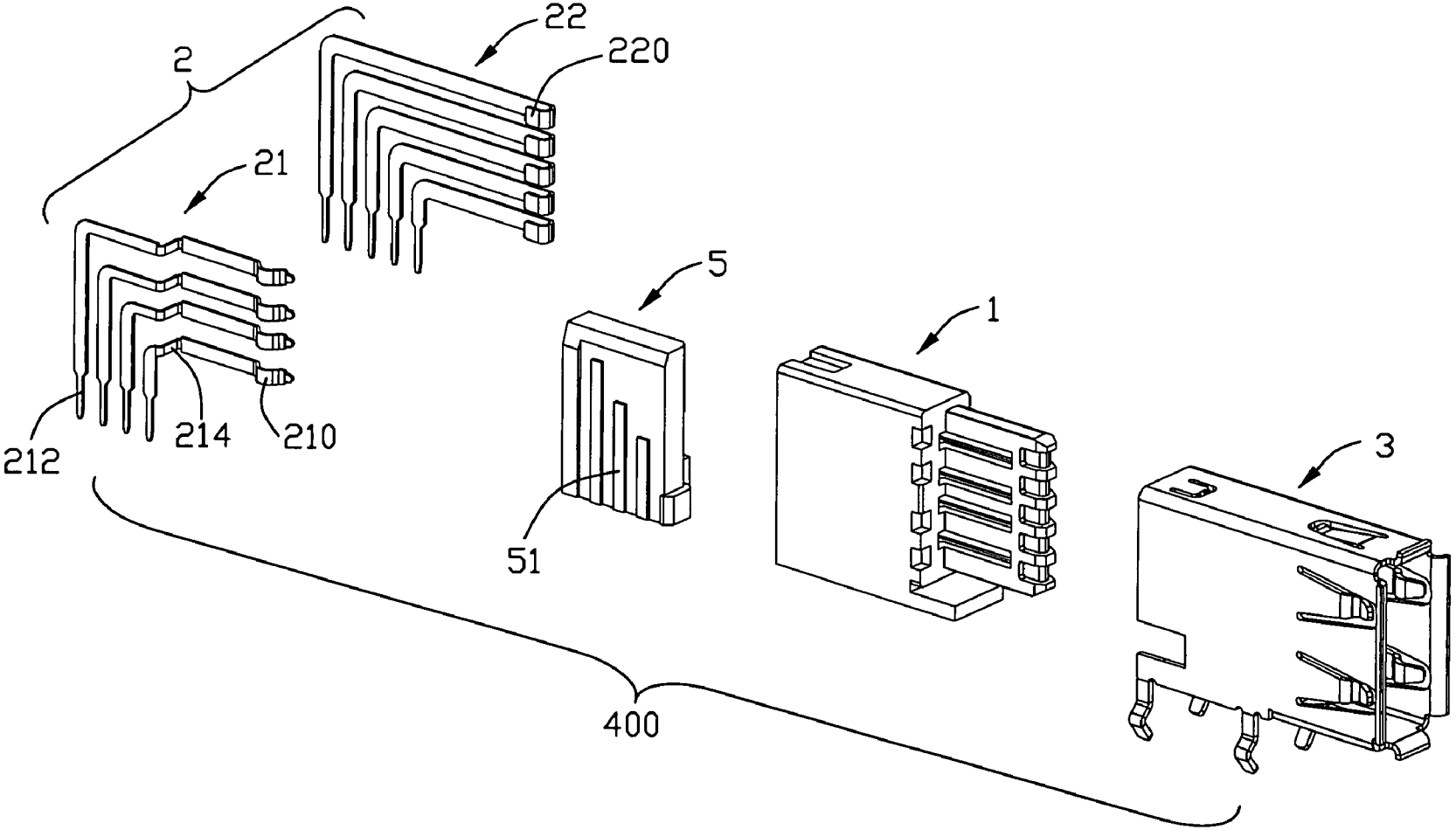
FIG. 15 is an exploded view of the electrical connector according to the fourth embodiment of the present invention.
Figure 16A:
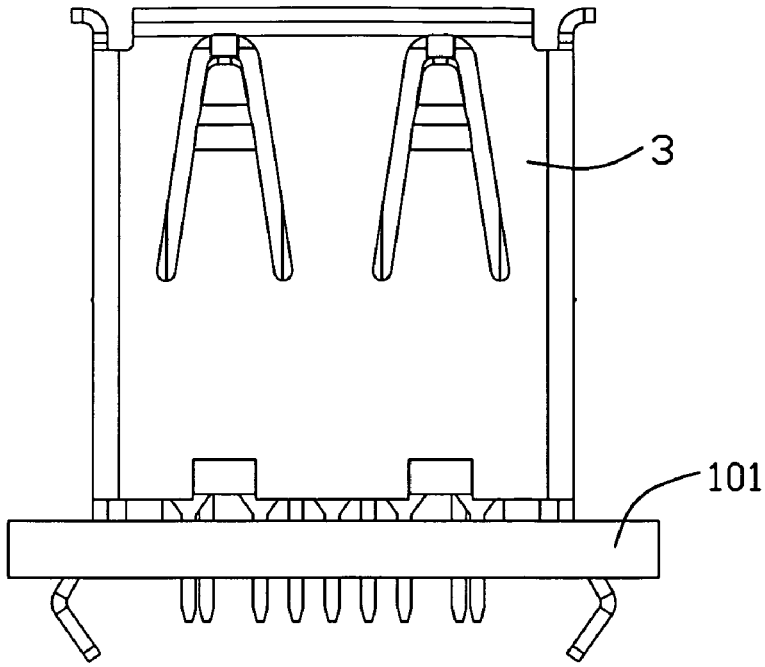
FIG. 16A is a perspective view of an electrical connector mounted on a mother PCB according to a fifth embodiment of the present invention.
Figure 16B:
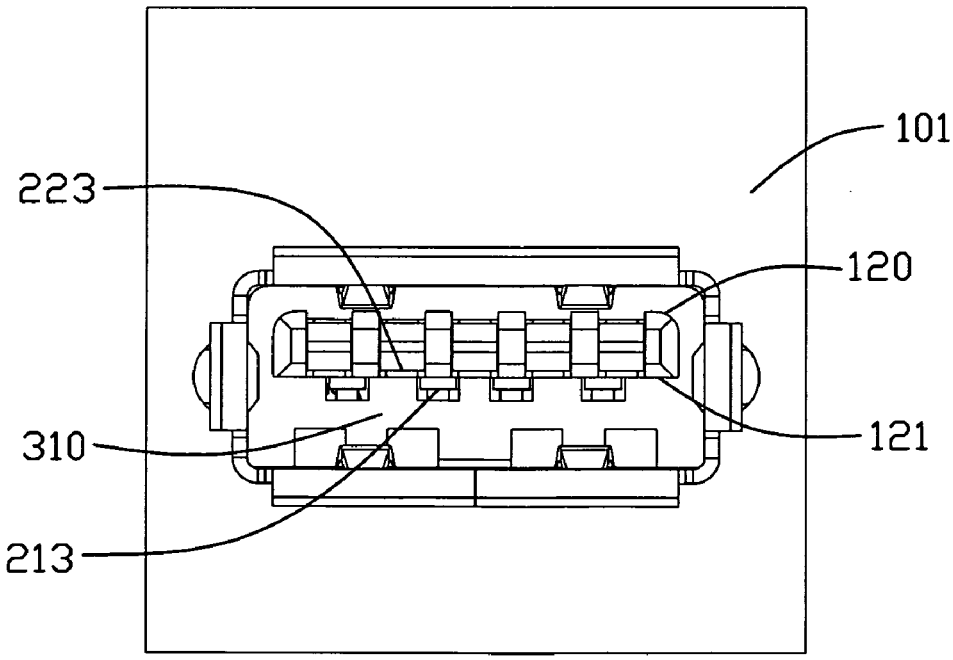
FIG. 16B is a view similar to FIG. 16A, while taken from a different aspect.
Figure 17:
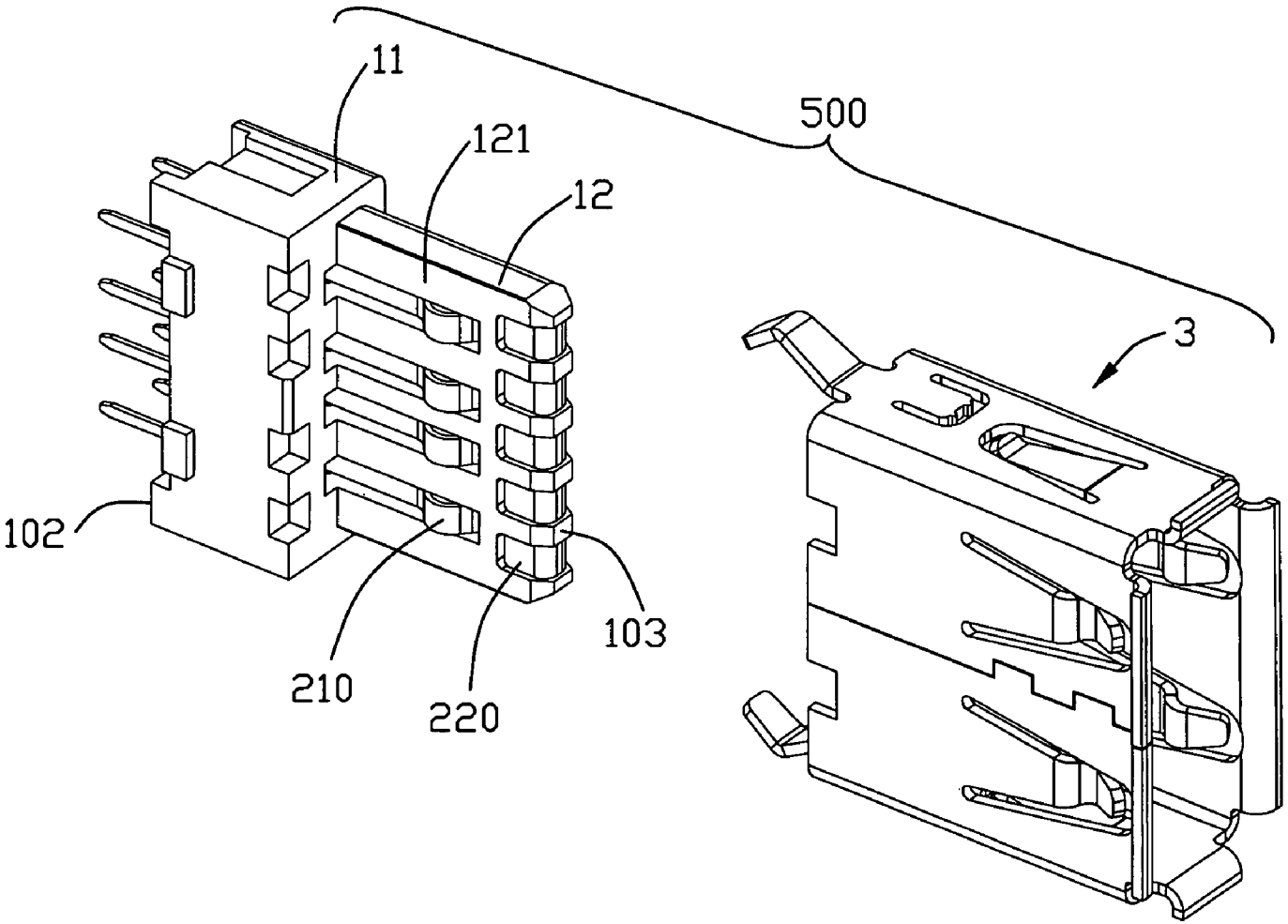
FIG. 17 is a partly exploded view of the electrical connector according to the fifth embodiment of the present invention.
Figure 18:
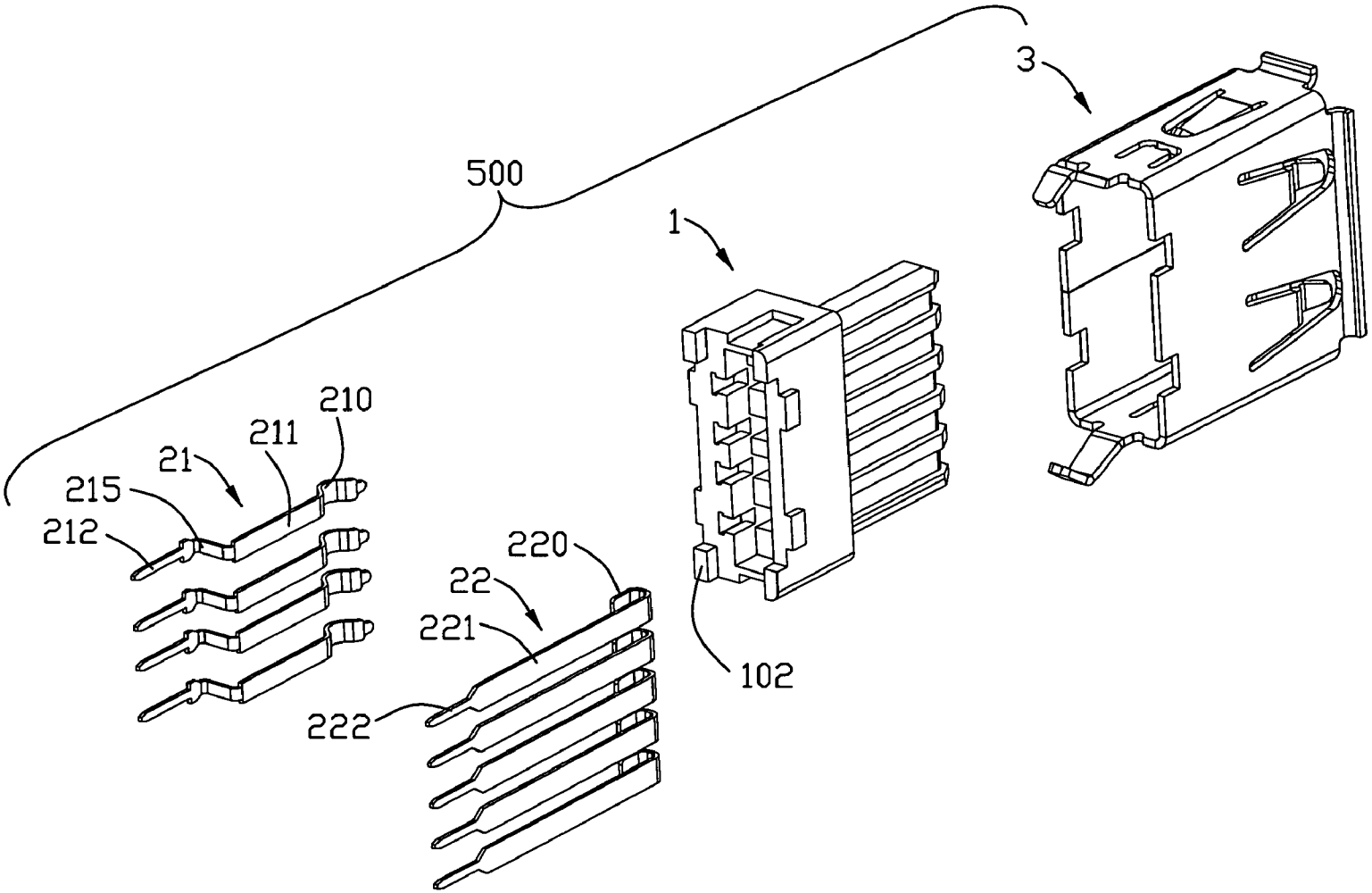
FIG. 18 is an exploded view of the electrical connector according to the fifth embodiment of the present invention.

Referring to FIGS. 9A-10, an electrical connector 300 according to a third embodiment is similar to the first embodiment shown in FIGS. 1A-7B, and differs in that, the electrical connector 300 is mounted on a PCB 101 having a mouth 104, the soldering legs 316 extend outwardly and laterally from a substantially middle portion of the side face 313 of the front shell 31, the mounting face 102 is defined as bottom faces of the soldering legs 316 and located above bottom wall 312 of the front shell 31, the electrical connector 300 is received in the mouth 104 to decrease the overall profile of the electrical connector 300 and the PCB 101. A supporting block 115 projects forwardly from a lower portion of the base portion 11 to be received in the mouth 104, the supporting block 115 is parallel to the tongue portion 12. A projection 39 extends rearward from a bottom wall 312 to be retained on the base portion 11, the supporting block 115 supports rear portion of the bottom wall 312.

Referring to FIGS. 11A-15, an electrical connector 400 according to a fourth embodiment is similar to the first embodiment shown in FIGS. 1A-7B, and differs in that, the tongue portion 12 of the electrical connector 400 is vertical to the mounting face 102, the first side face 121 and the second side face 120 are preferably configured as a left side face and a right side face of the tongue portion 12 respectively. The second contacting portions 220 are arranged orderly along an up-to-down direction and spaced from each other. A separating block 5 is sandwiched between the first contacts 21 and the second contacts 22. The base portion 11 defines a receiving cavity 116 recessed forwardly from a rear face thereof to receive the separating block 5, the first contacts 21 and the second contacts 22.

A plurality of bars 51 are formed on a left side face and a right side face of the separating block 5 and spaced from each other. The first retaining portions 211 each is fixed between two adjacent bars 51 on the left side face of the separating block 5, the second retaining portion 221 each is retained between two adjacent bars 51 on the right side face of the separating block 5. The first contact 21 has a transition portion 214 extending forwardly and then laterally from the first retaining portion 211. A rear portion of the transition portion 214 bias against an upper end of the bar 51, a lateral portion of the transition portion 214 abuts against a front face of the separating block 5.

Referring to FIGS. 16A-18, an electrical connector 400 according to a fifth embodiment is similar to the first embodiment shown in FIGS. 1A-7B, and differs in that, the receiving room 310 extends along an upper-to-down direction and exposed to the exterior, the tongue portion 12 is vertical to the mounting face 102. Both the first contacting portion 210 and the second contacting portion 220 lie on a left side of the second side face 120 of the tongue portion 12. The first retaining portion 211 is parallel to the first soldering portion 212, an angled portion 215 is formed between the first retaining portion 211 and the first soldering portion 212. The second retaining portion 221 is aligned with the second soldering portion 222 along the upper-to-down direction.

Figure 19A:
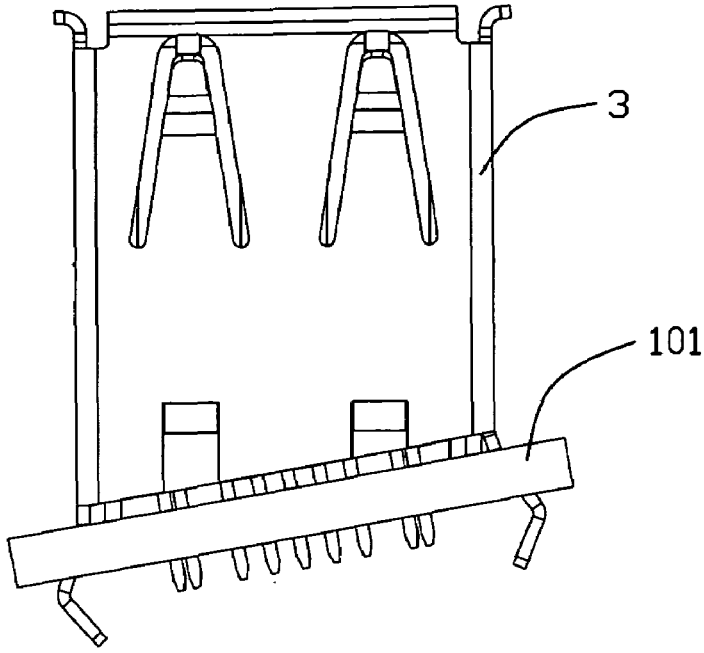
FIG. 19A is a perspective view of an electrical connector mounted on a mother PCB according to a sixth embodiment of the present invention.
Figure 19B:
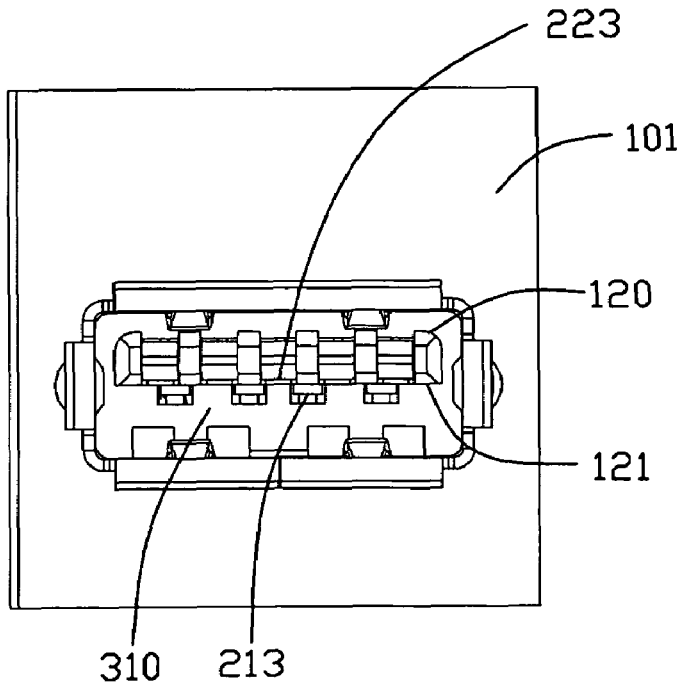
FIG. 19B is a view similar to FIG. 19A, while taken from a different aspect.
Figure 20:
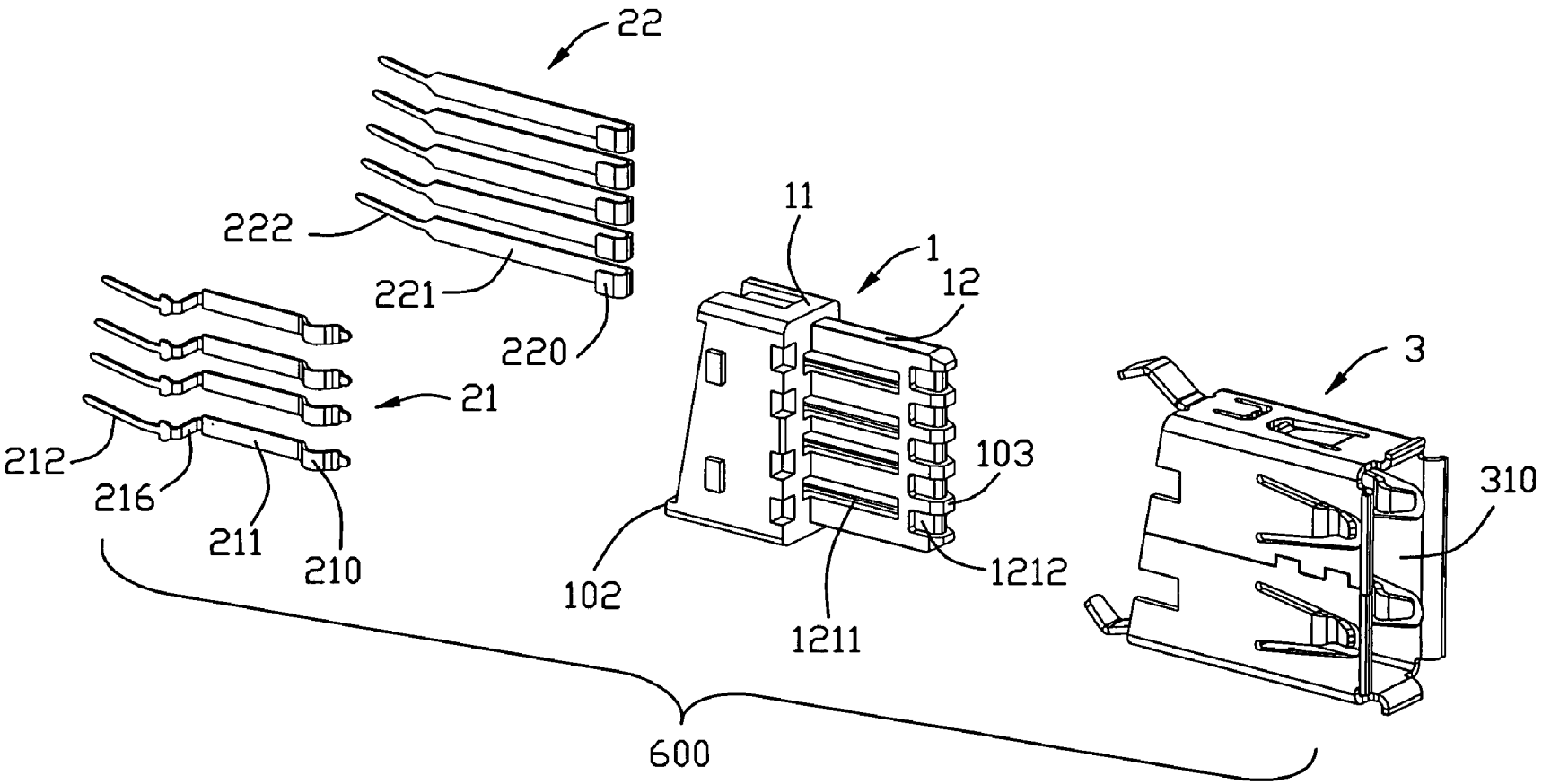
FIG. 20 is an exploded view of the electrical connector according to the sixth embodiment of the present invention.
Figure 21:
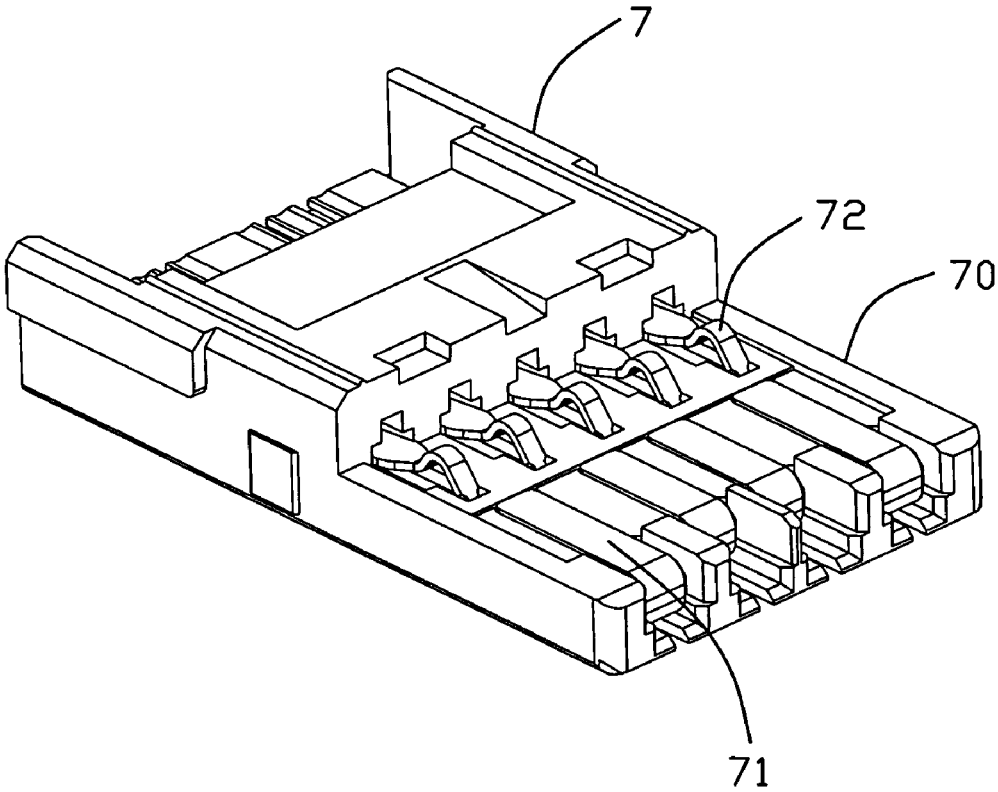
FIG. 21 a perspective view of a second plug according to the present invention.
Figure 22:
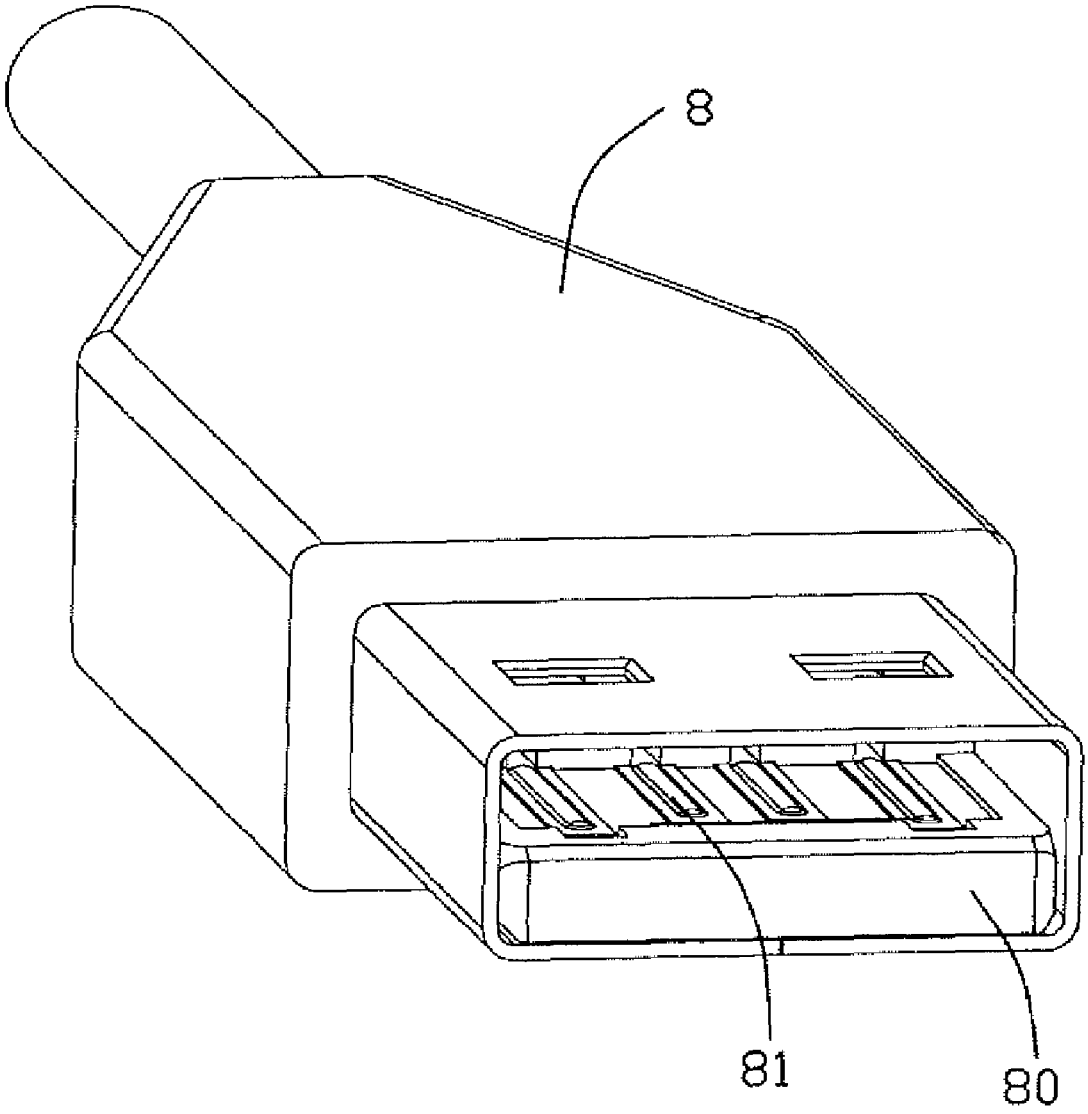
FIG. 22 (PRIOR ART)
FIG. 22 is a perspective view of an existing USB 2.0 standard type-A plug.

Referring to FIGS. 19A-20, an electrical connector 600 according to a sixth embodiment is similar to the first embodiment shown in FIGS. 1A-7B, and differs in that, the receiving room 310 extends along an upper-to-down direction and exposed to the exterior, the tongue portion 12 is vertical to the mounting face 102. Both the first contacting portion 210 and the second contacting portion 220 lie on a left side of the second side face 120 of the tongue portion 12. The first retaining portion 211 is parallel to the first soldering portion 212, a transition portion 216 is formed between the first retaining portion 211 and the first soldering portion 212. The second soldering portion 222 extends obliquely and downwardly from the second retaining portion 221 and the mounting face 102 is oblique to the mating face 103.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical connector to be mounted on a printed circuit board, comprising:

an insulative housing having a base portion, a tongue portion extending forwardly from the base portion and a plurality of passageways, the tongue portion being thinner than the base portion and defining a front face, a first side face and a second side face opposite to the first side face;

a metal shell attached to the base portion to enclose the tongue portion to define a receiving room therebetween, and defines a top wall, bottom wall and a pair of side walls, a first receiving room being formed between the bottom wall and the first side face, a second receiving room being formed between the top wall and the second side face;

a plurality of contacts received in the passageways respectively and including a plurality of first contacts and a plurality of second contacts, the first contacts each defining a first contacting portion, a first soldering portion and a first retaining portion connecting with the first contacting portion and the first soldering portion, the second contacts each defining a second contacting portion, a second soldering portion and a second retaining portion connecting with the second contacting portion and the second retaining portion; and wherein both the second contacting portions and the first contacting portions are positioned on a same side of the second side face to be exposed to the first receiving room, the second contacting portions are located between the first side face and the second side face, the first contacting portions extend beyond the first side face;

wherein the second contacting portion and the second retaining portion are parallel to each other, the second retaining portion is exposed to the second receiving room; and wherein the second contacts each defines a connecting arm to interconnect the second contacting portion and the second retaining portion, a concave portion is recessed from the front face of the tongue portion to receive the connecting arm.

2. The electrical connector as claimed in claim 1, wherein the second contacting portions are flat and non-elastic, the first contacting portions are elastic and deflectable along a height direction of the tongue portion.

3. The electrical connector as claimed in claim 1, wherein the first contacting portions are arranged in a first row, the second contacting portions are arranged in a second row which is located in front of the first row.

4. The electrical connector as claimed in claim 1, wherein the receiving room, the first contacts and the tongue portion are compatible to the USB 2.0 standard, the first contacts include a power contact, a D− signal contact, a D+ contact and a ground contact which are arranged orderly along a lateral direction of the tongue portion.

5. The electrical connector as claimed in claim 1, wherein the second contacts include a first pair of differential contacts, a second pair of differential contacts and a ground contact located between the first pair of differential and the second pair of differential contacts along a lateral direction of the tongue portion.

6. The electrical connector as claimed in claim 1, further comprising a separating block sandwiched between the first contacts and the second contacts, the base portion defines a receiving cavity recessed forwardly from a rear face thereof to receive the separating block.

7. The electrical connector as claimed in claim 6, wherein the separating block defines a plurality of bars formed on a left side and a right side thereof and spaced from each other, the first retaining portions each is fixed between two adjacent bars on the left side face of the separating block, the second retaining portions each is retained between two adjacent bars on the right side face of the separating block.

8. An electrical connector comprising:

a mounting face to be mounted onto a printed circuit board;

a front mating face to mate with a corresponding plug;

an insulative housing having a base portion, a tongue portion extending forwardly from the base portion and a plurality of passageways, the tongue portion being thinner than the base portion and defining a front face, a first side face and a second side face opposite to the first side face and located above the first side face;

a metal shell attached to the base portion to enclose the tongue portion to define a receiving room therebetween;

a plurality of contacts received in the passageways respectively and including a plurality of first contacts and a plurality of second contacts, the first contacts each defining a first contacting portion, a first soldering portion and a first retaining portion connecting with the first contacting portion and the first soldering portion, the second contacts each defining a second contacting portion, a second soldering portion and a second retaining portion connecting with the second contacting portion and the second retaining portion; and wherein both the second contacting portions and the first contacting portions are positioned on a same side of the second side face, the second contacting portions and the first contacting portions are not located on a same plane along a height direction of the tongue portion, the first contacting portions are arranged in a first row, the second contacting portions are arranged in a second row which is located in front of the first row;

wherein the second contacting portion and the second retaining portion are parallel to each other, the passageways include a plurality of first passageways for receiving the first contacts and a plurality of second passageways located in front of the first passageways to receive the second contacting portions, both the first passageways and the second passageways are formed on the first side face, and a plurality of third passageways formed on the second side face to receive the second retaining portions, the first passageways are parallel to the third passageways; and wherein the second contacts each defines a connecting arm to interconnect the second contacting portion and the second retaining portion, a concave portion is recessed from the front face of the tongue portion to receive the connecting arm.

9. The electrical connector as claimed in claim 8, wherein the second contacting portions are flat and non-elastic, the first contacting portions are elastic and deflectable along a height direction of the tongue portion.

10. The electrical connector as claimed in claim 8, wherein the receiving room, the first contacts and the tongue portion are compatible to USB 2.0 standard, the first contacts include a power contact, a D− signal contact, a D+ contact and a ground contact which are arranged orderly along a lateral direction of the tongue portion.

11. The electrical connector as claimed in claim 10, wherein the second contacts include a first pair of differential contacts, a second pair of differential contacts and a ground contact located between the first pair of differential and the second pair of differential contacts along a lateral direction of the tongue portion.

12. The electrical connector as claimed in claim 8, wherein the mounting face is oblique to the front mating face.

* * * * *